US006231349B1

(12) United States Patent
Bullinger et al.

(10) Patent No.: US 6,231,349 B1
(45) Date of Patent: May 15, 2001

(54) ELECTROMECHANICAL CONNECTING DEVICE

(75) Inventors: Achim Bullinger, Kirchstrasse 14, D-89551 Koenigsbronn-Zang; Klaus-Dieter Fritsch, Am Wiesenrain 16, D-89522; Hermann Neidlein, both of Heidenheim, all of (DE)

(73) Assignees: Achim Bullinger, Koenigsbronn-Zang; Klaus-Dieter Fritsch, Heidenheim, both of (DE)

( * ) Notice: Subject to any disclaimer, the term of this patent is extended or adjusted under 35 U.S.C. 154(b) by 0 days.

(21) Appl. No.: 09/254,248

(22) PCT Filed: Aug. 26, 1997

(86) PCT No.: PCT/EP97/04656

§ 371 Date: Jun. 4, 1999

§ 102(e) Date: Jun. 4, 1999

(87) PCT Pub. No.: WO98/09346

PCT Pub. Date: Mar. 5, 1998

(30) Foreign Application Priority Data

Aug. 29, 1996 (DE) ..... 296 15 005 U

(51) Int. Cl.[7] ..... H01R 11/30; H01R 13/60
(52) U.S. Cl. ..... 439/39; 439/1; 439/40
(58) Field of Search ..... 439/39, 38, 40, 439/1

(56) References Cited

U.S. PATENT DOCUMENTS 4,317,969 * 3/1982 Riegler et al. ..... 439/39

* cited by examiner

*Primary Examiner*—Brian Sircus
*Assistant Examiner*—Hae Moon Hyeon
(74) *Attorney, Agent, or Firm*—Welsh & Katz, Ltd.

(57) ABSTRACT

An electromechanical connecting device can be connected to a switching device provided with switching magnets, arranged on a working carriage and connectable to a current source by means of current supply contacts, and can also be connected to a triggering device provided with triggering magnets and electrically connectable to a consumer. These switching magnets can be moved from a rest position to a working position against a restoring force, establishing a contact among pairs of contacts and thus an electric connection between the means of a special coding together with the triggering magnets arranged in the triggering device to generate particular magnetic fields for the switching process. In the switching device, at least one safety part designed as a safety magnet or ferromagnetic material can be moved in the direction of the triggering device from a rest position into a live position by a matching magnet or ferromagnetic part arranged in the triggering device, so that when the safety part returns to its rest position it causes a intentional short-circuit between the poles of the pair of contracts of the switching divide even when the triggering device is removed, whereas the working carriage remains in the live state.

7 Claims, 2 Drawing Sheets

ELECTROMECHANICAL CONNECTING DEVICE

Figure 4:
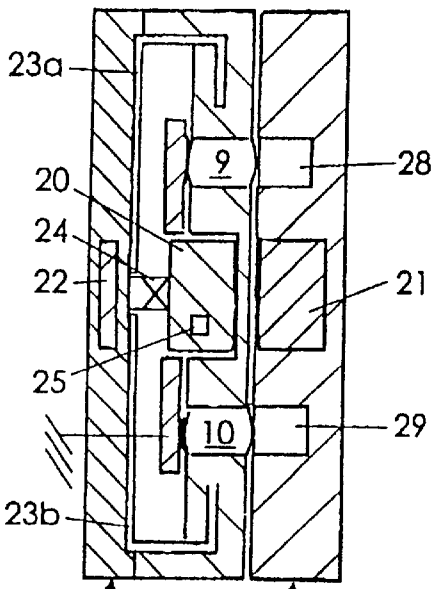

The invention relates to an electromechanical connecting device according to the type defined more closely in the preamble of claim 1.

A connecting device of this type is described in EP 0 573 471 B1. A connecting device which has a very shallow overall depth and which conforms, moreover, to high safety requirements is created by the previously known connecting device, which comprises a switching device which takes over the function of a socket-outlet of conventional type, and a triggering device which takes over the function of a plug connector.

Both the mechanical and the electrical contacts are made via magnets in the electromechanical connecting device according to EP 0 573 471 B1. For this purpose, both a working carriage, which can be connected to power supply contacts, and the switching magnets are electrically conducting. The current connection is routed directly via contact hats to triggering magnets in the triggering device, which magnets are likewise electrically conducting. However, it is disadvantageous with this current conduction that electrical conductivity leads in the case of a short circuit to a loss of the heat-sensitive magnetic components. Moreover, the previously known device is still of relatively wide design, because of the conduction of voltage and current via the contact hats and the magnets.

What is meant by coded magnets is that a plurality of small magnet parts of different polarities are connected to form an overall magnet. A magnetic attractive force can be achieved only by magnet parts which are appropriately oppositely polarized and coded in the same way. This is realized correspondingly by the cooperation of the magnets in the switching device and in the triggering device. By contrast with known magnets, no magnetic attractive force is produced.

It is ensured in this way that only in the case when the triggering device approaches or is mounted on the switching device is the working carriage raised from its rest position and brought into the electric switching position in which current is brought on to the two poles of the pair of contacts of the switching device. This current is then conducted to the consumer via the poles of the pair of contacts of the triggering device. After the triggering device has been raised, and thus after the magnetic force has been removed, the working carriage drops out again into the rest position, as a result of which the feeding of current to the two poles of the pair of contacts is interrupted.

The previously known electromechanical connecting device operates very reliably, particularly when the pair of electric contacts, and thus their poles, are arranged separately from the coded magnets. However, given the occurrence of very high and unexpected overvoltages, for example a short circuit, sticking or welding of parts in the triggering device could occur in extreme situations. In such a case, it could happen that the working carriage no longer drops out after removal of the triggering device, as a result of which current is present on the exposed, live pole. The risk of electrical accidents therefore exists.

Even if such a situation were scarcely likely to occur in practice given proper handling, it is, nevertheless, the object of the present invention to improve the electromechanical connecting device mentioned at the beginning so as to avoid electrical accidents even in an extreme situation in which the working carriage could become stuck in the live position, in particular to achieve an interruption in the current to the poles, nevertheless.

This object is achieved according to the invention by means of the features named in the characterizing part of claim 1.

In cooperation with the corresponding matching part in the triggering device, the safety part according to the invention in the switching device reliably prevents the live pole of the switching device from becoming live again should the working carriage become stuck in the live position of the live pole of the switching device. The inventors proceeded from the realization that when cooperating with a ferromagnetic material or another magnet, an appropriately "normal" magnet has its own magnetic field and —if necessary— a further reaching one, particularly if magnets of appropriate high quality are used, by comparison with the coded switching magnets. This means that the safety part in the switching device is always initially attracted by its matching piece in the triggering device, and then remains longer in the position than the coded switching magnets on the working carriage. Since, however, the safety part is independent of the working carriage, and thus also of the switching magnets and also of the conduction of current, it drops back into its rest position in any case upon disconnection of the triggering device. If the working carriage now remains in its live position and does not drop back into its rest position, the safety part, which has returned on its own to the rest position, can ensure a desired short circuit and thus the interruption of current to the exposed contact elements. All that is required for this is to provide suitable current-conducting paths. Thus, for example, in the event of a missing consumer, the current can be conducted through the welded carriage from the top side to the bottom side of the contact points. However, since the safety part has moved back into its rest position and is therefore situated below the working carriage, in this position it can bridge the two poles of the pair of contacts of the switching device. This produces a short circuit which interrupts the entire supply of current at a corresponding point.

This can be performed in a simple way by virtue of the fact that a glow protection device which burns through in the event of a short circuit is arranged in the switching device or a part connected to the switching device. Such glow protection devices situated appropriately in live lines are generally known.

A structurally simple and space-saving arrangement and design of the safety part can consist in that the safety part is situated in a cutout in the working carriage, preferably in a central region.

For the purpose of simple and acceptable functioning of the safety part, provision is made below or behind the safety part on the side averted from the triggering device of a magnet or a part made from a ferromagnetic material, by means of which the safety part is brought back reliably into the rest position. All that may be ensured is that the magnetic attractive force between the safety part and the magnet or the ferromagnetic material arranged there behind or there below is less than the magnetic attractive force exerted by the matching piece in the triggering device. This can be achieved in a simple way by the strength of the magnet and/or the respective spacings.

A very advantageous development of the invention can consist in that the safety part is provided on the circumference with projecting knobs or pins, the safety part executing a rotary movement about its longitudinal axis when moving from the rest position into the electrically switched position, and the working carriage having cutouts which are matched to the size and shape of the knobs or pins and hold the knobs or pins in the live position of the working carriage.

An additional degree of safety is achieved by rotating the safety part as it moves. This merely requires the rotation to be controlled such that in the live state the knobs or pins are located in such a position that they are situated in the corresponding cutouts in the working carriage. In the normal case, the coded switching magnets firstly return to their rest position when the triggering device is disconnected, in particular when they are supported by restoring springs. The safety part follows correspondingly later with a rotation. The result of this rotation is that in the rest position the knobs or pins are no longer aligned with the cutouts. However, in this position the knobs or pins press on to the working carriage and hold the latter in its rest position. This means that it is also impossible in the rest position for undesired vibrations of the working carriage to occur, for example because of external shocks or shaking. Rather, the working carriage is fixed tightly clamped between the knobs or pins of the safety part and the lower or rear wall of the switching device.

Conversely, in the case of activation the result of this is that it is firstly necessary for the safety part to move into the live position before the working carriage can follow. Only after the safety part rotates on the path into the electrically switched position can the cutouts of the working carriage slide over the knobs or pins and thus become aligned, after which the electric switching is performed.

Figure 3:
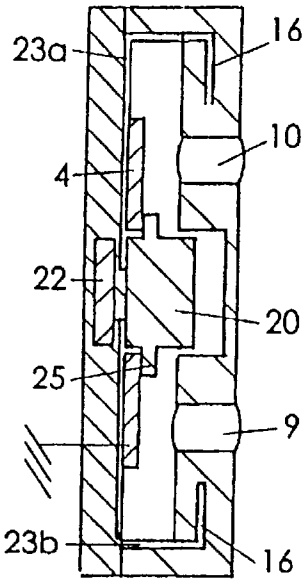
Figure 2:
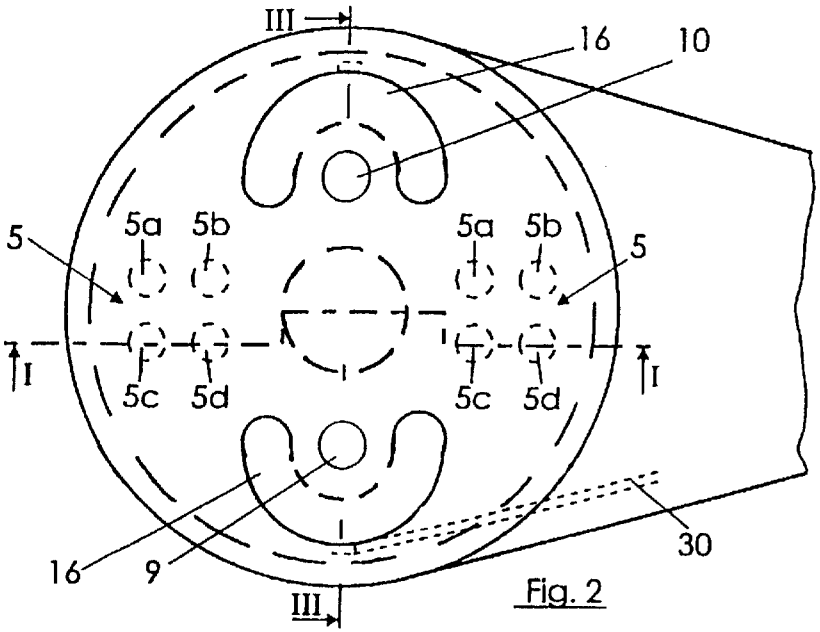
Figure 1:
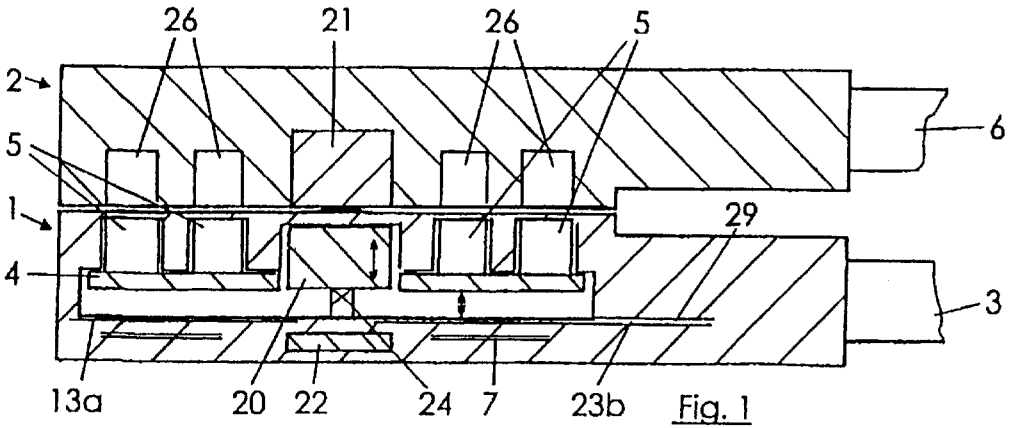
Figure 8:
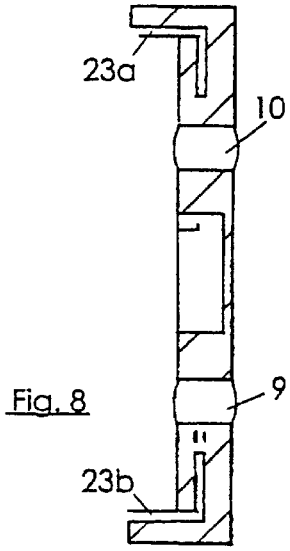
Figure 5:
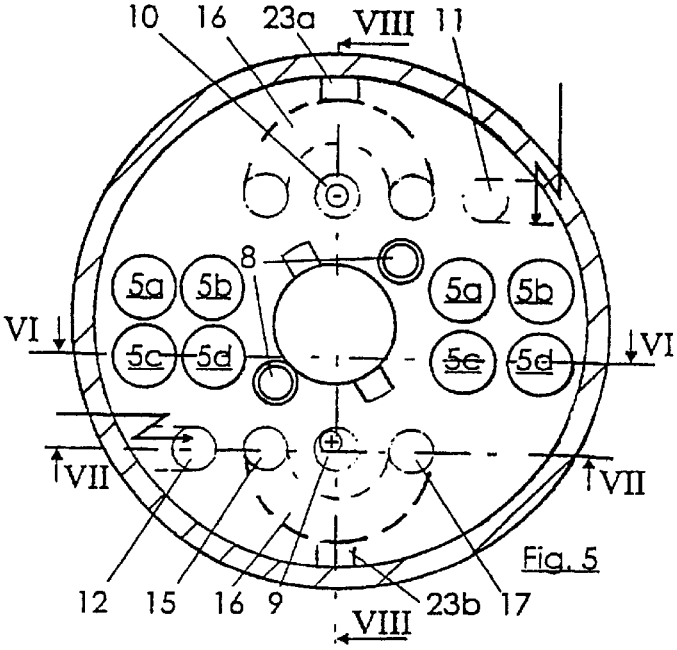
Figure 11:
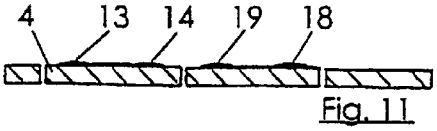
Figure 6:
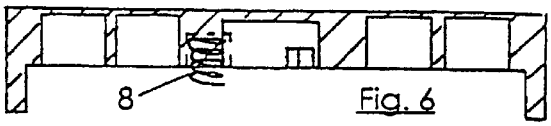
Figure 10:
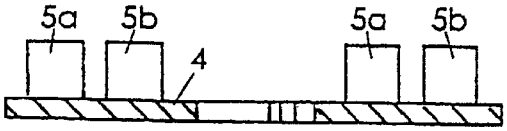
Figure 7:
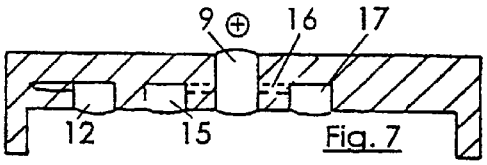
Figure 9:
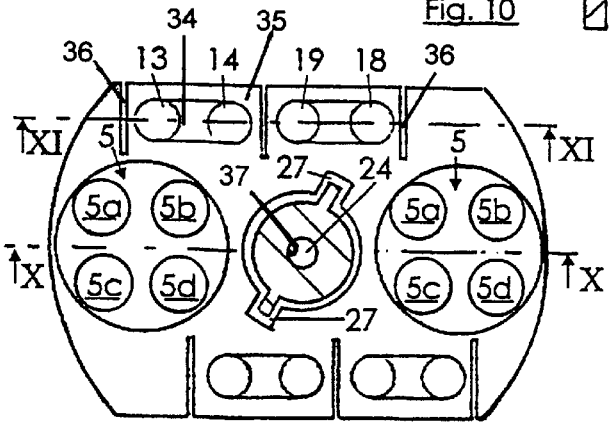
Figure 12:
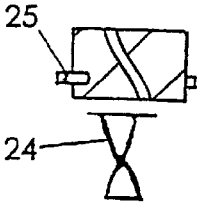

Advantageous developments and refinements follow from the remaining subclaims and from the following exemplary embodiment described with the aid of the drawing, in which:

FIG. 1 shows a section along the line I—I through the switching device and the triggering device mounted thereupon, FIG. 2 shows a top view of the switching device, FIG. 3 shows a section along the line III—III in FIG. 2 with the working carriage in the rest position, FIG. 4 shows a section corresponding to that of FIG. 3, with the mounted triggering device in section and the working carriage in a live state, FIG. 5 shows a section through the switching device, FIG. 6 shows a section along the line VI—VI in FIG. 5 through the upper housing part of the switching device, FIG. 7 shows a section along the line VII—VII in FIG. 5 through the upper housing part of the switching device, FIG. 8 shows a section along the line VIII—VIII in FIG. 5 through the upper housing part of the switching device, FIG. 9 shows a top view of the working carriage, FIG. 10 shows a section along the line X—X in FIG. 9, FIG. 11 shows a section along the line XI—XI in FIG. 9 and, FIG. 12 shows an enlarged representation of the safety part with a helical pin for guiding it.

The electromechanical connecting device comprises a switching device 1 which replaces the function of a conventional socket-outlet and which is permanently installed in general at a desired point if it does not serve as an adapter for connecting to conventional socket-outlets or as an extension cable, and comprises a triggering device 2 which replaces the function of a conventional plug connector, which is generally connected to a consumer or which is arranged directly on a consumer. As soon as an electrically conducting connection is made between the switching device 1 and the triggering device 2, the respective consumer, which is connected to the triggering device 2, is correspondingly supplied with current.

The switching device 1 has a closed assembly which, in a way not represented in more detail, comprises a housing 31 and a cover 32. A cable connection 3 opens into the switching device 1 for the purpose of connecting it to the current source. The triggering device is likewise generally constructed in two parts and provided with a cable connection 6 if the triggering device 2 does not itself constitute a part of a consumer, or is directly installed in the consumer.

In the state of rest, that is to say when the triggering device 2 is not mounted on the switching device 1, a working carriage 4, on which switching magnets 5 are arranged in the form of coded magnet parts 5*a*–5*d*, is held on the base of the housing by a ferromagnetic restraining plate 7. The ferromagnetic restraining plate can also be a magnet ring. As can be seen from FIG. 2, two coded switching magnets 5 with four coded magnet parts 5*a*–5*d* in each case are situated diametrically opposite one another. Each coded magnet 5, comprising the quad group, has in each case two north poles and two south poles, the poles being arranged relative to one another such that different polarities border one another in each case. The coded magnets 5 are arranged in the interior of the switching device 1 on the working carriage 4 such that they are guided in corresponding bores 33 when they move (see FIG. 1, for example.)

Two diametrically opposite restoring springs 8, which are likewise guided in bores in the switching device, ensure that the working carriage 4 is additionally held on the ferromagnetic restraining plate 7 in the non-switched state by a corresponding spring force. At the same time, they ensure that after the triggering device 2 has been removed from the switching device 1 the working carriage 4 is brought to bear again on the ferromagnetic restraining plate 7. FIGS. 5 to 11 show in more detail the current conduction in the switching device up to a live pole 9 and a neutral pole 10 as neutral conductor. The poles 9 and 10 are constructed as pins and project freely from the top side of the switching device, essentially flush with the top side.

The current is introduced from the cable connection 3 to a contact element 11 (neutral conductor) and a contact element 12 (phase) in the upper housing region. For the sake of clarity, in what follows the course of the current via bridges and contact elements is represented only for the input contact 12. Located below the input contact 12 on the working carriage is a contact element 13 which conducts the current via an electric bridge 34 to a further contact element 14 on the working carriage. Located about the contact element 14 in the housing upper part is a further contact element 15 which, in turn, is in electric contact via an arcuate bridge 16 with a contact 17 which is likewise located in the upper housing part. Located below the contact element 17 on the working carriage 4 is a contact element 18 which, in turn, is connected via an electrically conducting bridge to a contact element 19 on a working carriage. The contact element 19 is located below the pole 9 leading to the surface of the switching device. As can be seen from FIGS. 9 and 11, the contact elements 13, 14 and 18, 19 are located on elastic tongues 35 on the working carriage, which are formed by corresponding slits 36 in the working carriage. Appropriately full contact is made in this way when current is conducted.

The current could be conducted in principle from the upper housing part of the switching device via the working carriage and back to the upper housing part and thus to the pole 9, also via a simple bridge. However, the realization via the two bridges, and the arcuate bridge part 16 in the upper housing part have the advantage that it is possible in this way to reduce to half the spacings required by the current intensity in the state of rest and the non-switched state. The semicircular bridge 16 is required in this case only for structural reasons, in order to "get past" the pole 9 or 10.

FIG. 9 also shows the contact elements and bridges on the working carriage for conducting the current to the pole 10. The annular bridge for this is likewise to be seen from FIG. 5, in the upper part of the drawing.

The present electromechanical connecting device has a safety part 20 which is either constructed as a safety magnet which cooperates with corresponding ferromagnetic plates or matching parts, or it comprises a disk made from ferromagnetic material. In the present exemplary embodiment, the safety part 20 is formed from a disk made from a disk made from a ferromagnetic material, and a magnet 21 cooperating with the safety part 20 is located in the triggering device 2. A further restoring magnet 22 is located in the lower part of the switching device 1. As can be seen from the figures, the safety part 20 is located in the central region of the switching device, and the magnet 21 in the triggering device 2 is situated directly thereabove when the triggering device 2 is situated directly thereabove when the triggering device is mounted on the switching device 1. In the same way, the restoring magnet 22 is situated directly below the safety part 20 (see, in particular, FIGS. 1, 3, and 4).

The mode of operation of the safety part 20, in particular, can be seen from FIGS. 2 to 5. From the arcuate bridge 16, safety lines 23*a* and 23*b* respectively lead downward to both sides as far as the lower housing region of the switching device 1, and from there inward along the base up to the region of the safety part 20. The safety part 20 is provided with a central bore 37. This bore 37 serves as a guide on a mandrel 24. The circumference of the mandrel 24 is of helical shape. This helical shape cooperates with a corresponding matching helix of the central bore, which is constructed helically in accordance therewith, in the safety part 20. Furthermore, the safety part 20 is provided on its circumference with two diametrically opposite knobs or pins 25. The mandrel 24 is permanently connected to the lower region of the housing of the switching device 1. Owing to the helical shape of the mandrel 24 and the helical bore in the safety part 20, the safety part moves with a corresponding rotation downward and upward. The two pins 25 projecting from the circumference of the safety part 20 are rotated correspondingly in this way in their circumferential position. The safety part functions in the following way:

In the state of rest (see FIG. 3), the safety part is situated on the working carriage 4 and thereby presses the latter working carriage 4 onto the housing underside of the switching device 1 because of the magnetic force of the safety part 20 in cooperation with the restoring magnet 22. If the triggering device 2 is mounted on the switching device 1, the magnet 21 attracts the safety part 20, as a result of which the safety part 20 correspondingly moves upward together with a slight rotary movement. The working carriage 4 follows, it being the case that for this the coded magnets 5, which cooperate with correspondingly oppositely coded magnets 26 in the triggering device 2. In order to develop the required magnetic force, the coded magnets 26 are assembled in the same way into two quad groups each having four individual magnets, the individual magnets being oppositely polarized in a way corresponding to the individual magnets 5*a*–5*c* of the switching device.

With the attraction of the working carriage to the underside of the housing upper part of the switching device 1, the connection of the input contacts 11 and 12 to the poles 9 and 10 is also created via the contact elements 13, 14, 15 and 17. The current path for the phase arriving in the case of the input contact 12 is in this case from the input contact 12 to the contact element 13 on the working carriage 4, and there to the contact element 14, and subsequently back on to the housing upper part to the contact element 15 and via the circularly arcuate bridge 16 tot he contact element 17. From there, the current passes again to the contact element 18 on the working carriage, and from there via the contact element 19 back to the pole 9 arranged in the housing upper part. The current flows from the input contact 11 to the pole 10 in an equivalent way.

If the triggering device 2 is removed from he switching device 1, the working carriage 4 firstly drops away because of the smaller magnetic force of the coded magnets, as a result of which the circuit is interrupted. Subsequently, the safety part 20 also drops away with a corresponding rotation, since it is attracted by the restoring magnet 22. In the process, there is a slight rotation, with the result that the pins 25 projecting beyond the circumference are laid onto the working carriage in the lower position. However, in the live state the projecting pins 25 do not disturb the movement of the working carriage 4, because in this position they are located in cutouts 27 in the working carriage 4 which are matched to the larger shapes of the pins 25. This position can be seen from FIG. 9.

If, for any reason, the working carriage remains, for example by sticking, in its upper position even when the triggering device 2 is removed, this means that the flow of current has been passed on as far as the poles 9 and 10. In the normal case, the poles 9 and 10 would make the current contact to the corresponding matching contacts 28 and 29 in the triggering device, in order to supply the desired consumer with current. Given the absence of the triggering device 2, there would now be the risk of electrical accidents because of the exposed poles 9 and 10. The safety part 20 is provided so that, nevertheless, no current will reach the poles 9 and 10 in this case. Specifically, after removal of the triggering device 2, the safety part 20, which, after all, operates independently of the working carriage 4 and in this regard can move freely in a corresponding bore in the working carriage 4, is attracted by the restoring magnet 22. This means that it returns to its rest position and is therefore seated on the housing lower part. Since, however,-by contrast with the normal rest position of the working carriage 4 in its lower position in accordance with FIG. 3-in such a case when the working carriage 4 has remained on the lower side of the housing upper part of the safety part 20, current on the arcuate bridge 16. The current from the two arcuate bridge 16 is conducted downward as far as below the safety part 20 via the safety line 23*a* and 23*b*. This means that as soon as the safety part 20 returns to its rest position after removal of the triggering device 2, a desired short circuit is created between the two poles 9 and 10. This short circuit can then be used to interrupt the overall supply of current. This can be done, for example, by providing in the cable feed 3 or at the current feed on the input side in the switching device 1 a glow protection device 30 known per se, which burns through in this case and thereby reliably interrupts the current connection.

What is claimed is:

1. An electromechanical connecting device assembly comprising a switching device, for connection to a current source, having a first magnet or a ferromagnetic piece in said switching device, and a triggering device with a second magnet or ferromagnetic piece, said switching device and said triggering device, each having a pair of contacts, said triggering device having a third series of coded magnets in said triggering device cooperating with a fourth series of coded magnets on a carriage for movement of said carriage within the switching device toward and away from said third series of magnets, for making an electric connection with said carriage between said switching device and the triggering device in a live position via said contacts, said first magnet or said ferromagnetic piece is displaceable in the direction of the triggering device from a rest position into the live position by the second magnet or the second ferromagnetic piece, said first magnet or said ferromagnetic piece being independent from the movement of said carriage so that with the working carriage remaining in the live state after removal of the triggering device and with current on the contacts of the switching device, when the first magnet or ferromagnetic piece returns to the rest position an intentional short circuit is effected between the poles of the pair of contacts of the switching device to interrupt the current.

2. The electromechanical connecting device assembly of claim 1, wherein a glow protection circuit is in the switching device or in a part connected to the switching device.

3. The electromechanical connecting device assembly of claim 1, wherein the first magnet or ferromagnetic piece is in a central cutout in the working carriage.

4. The electromechanical connecting device assembly of claim 3, wherein a fifth magnet or a fifth ferromagnetic piece is behind or below the first magnet or ferromagnetic piece on the side of the switching device averted from the triggering device.

5. The electromechanical connecting device assembly of claim 1, wherein the first magnet or ferromagnetic piece has a pair of pins on the circumference, and executes a rotary movement about its longitudinal axis when moving from the rest position into the first position, and the working carriage having cutouts matched to the pair of pins to hold the pins in the first position.

6. The electromechanical connecting device assembly of claim 5, wherein the first magnet or ferromagnetic piece can be moved in a helical or spiral movement from the rest position into the first position.

7. The electrochemical connecting device assembly of claim 6, wherein the first magnet or ferromagnetic piece is mounted on a mandrel, the rotary movement of the magnetic connection device being driven by a spiral path in the mandrel which said first magnet or ferromagnetic piece follows.

* * * * *